US006176708B1

(12) United States Patent
Michiya

(10) Patent No.: US 6,176,708 B1
(45) Date of Patent: Jan. 23, 2001

(54) PRESS-CONTACT CONNECTOR

(75) Inventor: Hajime Michiya, Tokyo (JP)

(73) Assignee: Shin-Etsu Polymer Co., Ltd., Tokyo (JP)

( * ) Notice: Under 35 U.S.C. 154(b), the term of this patent shall be extended for 0 days.

(21) Appl. No.: 09/483,051

(22) Filed: Jan. 13, 2000

(30) Foreign Application Priority Data

Jan. 22, 1999 (JP) ..... 11-014807

(51) Int. Cl.[7] ..... H01R 12/00
(52) U.S. Cl. ..... 439/66
(58) Field of Search ..... 439/66, 91, 591; 29/883, 884

(56) References Cited

U.S. PATENT DOCUMENTS

| | | | | |
|---|---|---|---|---|
| 3,795,037 | | 3/1974 | Willem | 439/591 |
| 4,330,165 | | 5/1982 | Sado | 439/91 |
| 4,593,961 | * | 6/1986 | Cosmo | 439/66 |
| 5,759,048 | * | 6/1998 | Korsunsky et al. | 439/66 |
| 5,893,761 | * | 4/1999 | Longueville | 439/66 |

FOREIGN PATENT DOCUMENTS 0789427 8/1997 (EP) .

* cited by examiner

*Primary Examiner*—Neil Abrams
(74) *Attorney, Agent, or Firm*—Reed Smith LLP

(57) ABSTRACT

Disclosed is a novel connector of press-contact type used for electrical connection between sets of electrode terminals on two oppositely facing circuit boards. The connector consists of a pair of elongated supporting bar members of a rubber each having an approximately triangular cross section and adhesively bonded together at one flat side surface of each member in a displaced disposition leaving unbonded areas and an array of metal filaments in a parallel alignment at a regular pitch, the filament array being sandwiched between the supporting members at the adhesively bonded interface reaching the periphery of the respective supporting members. When the connector is interposed between circuit boards, elongated void spaces are formed each as defined by the side surface of one of the supporting members, the array of metal filaments and one of the circuit boards, the end points of the metal filaments being brought into contact with the electrode terminals on the circuit boards with appropriate elastic resilience under compression. A method for the preparation of the press-contact connector is disclosed.

8 Claims, 7 Drawing Sheets

PRESS-CONTACT CONNECTOR

BACKGROUND OF THE INVENTION

The present invention relates to a novel press-contact connector for electrical connection between circuit boards in a compact-size electronic instrument including, typically, mobile phones or, in particular, for electrical connection between the electrode terminals on a fixed circuit board and the electrode terminals on a flexible circuit board of the TAB (tape-automatic bonding) type as well as to a method for the preparation of the connector.

As is known, press-contact connectors are classified into several types including rubber connectors, metal filament connectors, metal-filament matrix connectors and U-formed metal filament connectors. These different types of connectors are each required to have adaptability to compensation for mounting errors and low conduction resistance. The above mentioned rubber connector has a structure formed from an alternation of electroconductive and insulating layers each of a rubbery material such as a silicone rubber. Such a rubber connector is prepared by slicing a rubber block having an alternately stratified structure of two types of rubber sheets in a plane in the direction of stratification and slitting the slices into connector strips. The metal filament connector is prepared by slitting an integral body of two insulating rubber sheets sandwiching an array of metal filaments aligned in an arrangement at a uniform pitch into strips in a direction perpendicular to the running direction of the metal filaments.

The metal-filament matrix connector is prepared by slicing an alternately laminated block of insulating rubber layers and arrays of metal filaments running in one and the same direction and each sandwiched between two adjacent rubber layers in a direction perpendicular to the plane of the rubber sheets into slices which are each slitted in a suitable width. The U-formed metal filament connector is prepared by arranging a plurality of metal filaments in parallel each to the others on the surface of an insulating rubber sheet at a regular pitch to form a metal filament-bearing sheet which is introduced into and molded in the cavity of a metal mold having a U-formed cross section followed by filling of the cavity with an insulating rubber so that the connector has a plurality of metal filaments exposed on the outer surface of the insulating rubber body.

The press-contact connectors are used in recent years, besides the use for electrical connection between an LSI and a printed circuit board or between two printed circuit boards, for electrical connection between circuit boards in a compact-size intercommunication instrument represented by mobile phones or, to say more particularly, between a set of electrode terminals on a fixed circuit board and a set of electrode terminals on a flexible circuit board of TAB. It is very important for the press-contact connector in such an application that electrical connection through the connector between the sets of electrode terminals is complete even with a very small contacting pressure since otherwise warping or twisting deformation may occur in the casing or circuit boards of the compact-size intercommunication instrument which is so compact and light-weighted as not to withstand a large contacting pressure.

The press-contact connectors of the above described types each have several problems when used for electrical connection between circuit boards in a very compact intercommunication instrument. In the rubber connectors, for example, troubles are sometimes encountered due to delay or loss of transmission of digital signals as a consequence of the relatively large electric resistance of the conductive rubber layers so that rubber connectors cannot be used for connection between circuit boards in a compact-size intercommunication instrument in view of a possible failure in the performance of the instrument.

Each of the press-contact connectors of the other types utilizing metal filaments as the conductive body is not absolutely unsuitable for electrical connection between circuit boards in a compact-size intercommunication instrument because the contacting pressure can be so reduced when the metal filaments each take a slanted disposition or a bent or curved form. The contacting pressure ultimately required in the connectors of these types, however, depends on the hardness of the rubber as the material of the matrix and the size of the connector per se or, namely, the contacting area so that the above mentioned slanted disposition or bent or curved form of the metal filaments alone is not always sufficient to fully ensure a low contacting pressure for electrical connection.

As a means to solve the above described problems, it would be a due idea to use a rubber of decreased rubber hardness, to have a decreased contacting area or to increase the amount of compression. A rubber material of a low rubber hardness, however, has other problems of an increase in the permanent compression set and an increased rate of thermal denaturation or elastic fatigue. The contacting area of a press-contact connector cannot be decreased to be small enough and a serious disadvantage of poor handling adaptability is resulted by the use of a press-contact connector with an excessively small contacting area. When the amount of compression in the press-contact connector is decreased, the error in mounting can no longer be absorbed resulting in failure of electrical connection through the connector.

A conclusion derived from the above consideration is that absorption of mounting errors under a condition of a decreased contacting load can be accomplished only by the use of an auxiliary member such as a rubber plate or rubber tube having an open space available for decreasing the contacting area. Serious problems accompanying the use of such an auxiliary member are that the connection height is necessarily increased so much and that the number of the parts forming the instrument is necessarily increased so many.

SUMMARY OF THE INVENTION

The object of the present invention is, accordingly, to provide, by overcoming the above described disadvantages in the prior art press-contact connectors, a novel and improved press-contact connector suitable for electrical connection between circuit boards in a compact-size intercommunication instrument under a low contacting load with reliability and without affecting the handling adaptability and absorbability of mounting errors caused in the assembling works of the instruments and without increasing the number of the parts constituting the instrument as well as to provide a method for the preparation of such a press-contact connector.

Thus, the present invention provides a press-contact connector for electrical connection between sets of electrode terminals on two oppositely facing circuit boards by being interposed therebetween under a contacting pressure thereon, which is an integral elongated bar-formed body comprising:

(a) a pair of a first supporting member and a second supporting member each having an approximately triangular cross section and made from an electrically insulating rubber and each adhesively bonded to the other at one of the side surfaces in a displaced disposition, the first supporting member coming into contact with a first circuit board and the second supporting member coming into contact with a second circuit board when the connector is interposed between the first and second circuit boards, with the interface plane inclined relative to the surfaces at which the supporting members are in contact with the circuit boards; and (b) an array of a plurality of electroconductive filaments in a parallel alignment sandwiched between the first and second supporting members at the interface therebetween, each of the filaments extending to reach the electrode terminals on the first and second circuit boards by running in an inclined direction on and along the surfaces of the supporting members, in which the first and second supporting members are disposed symmetrically relative to the center line on the interface between the first and second supporting members, a first elongated void space is defined by the first supporting member, the array of the filaments and the first circuit board and a second elongated void space is defined by the second supporting member, the array of the filaments and the second circuit board.

DETAILED DESCRIPTION OF THE PREFERRED EMBODIMENTS

In the following, several preferable embodiments of the present invention are described in detail by making reference to the accompanying drawing although these embodiments never limit the scope of the invention in any way.

Figure 1:
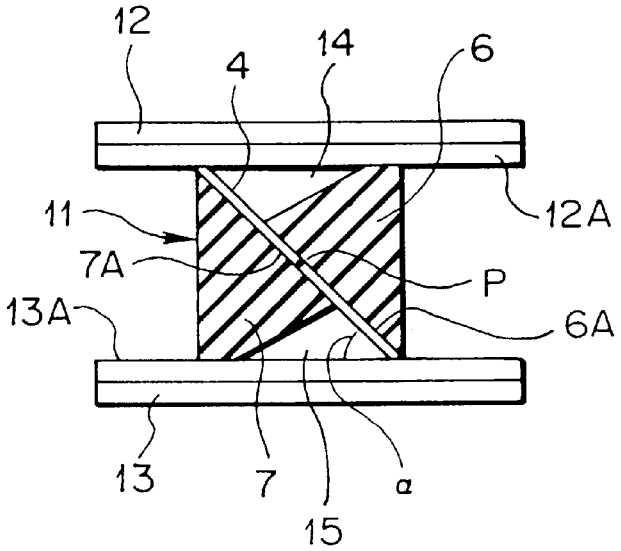
FIGS. 1 and 2 are each a cross sectional view of the inventive press-contact connector in an uncompressed state and compressed state, respectively, as interposed between two circuit boards.
Figure 2:
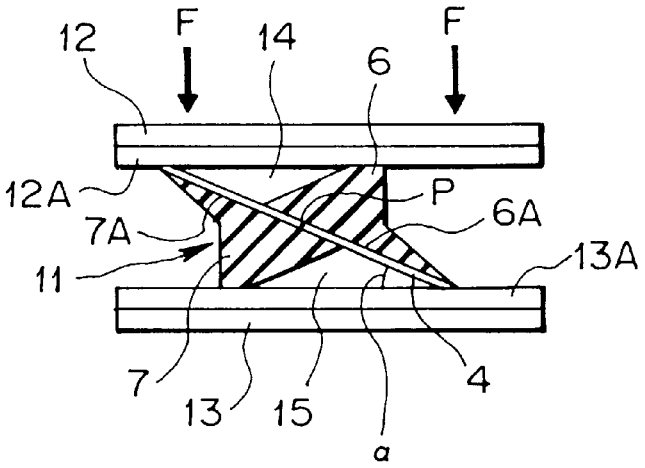

A first embodiment of the inventive press-contact connector is illustrated in FIGS. 1 to 4, of which FIGS. 1 and 2 illustrate the press-contact connector 11 interposed between two oppositely facing circuit boards 12,13 either without compression (FIG. 1) or under compression (FIG. 2). The circuit board 12 is assumed to be a flexible circuit board while the circuit board 13 is assumed to be a fixed circuit board.

The press-contact connector 11 is formed from an array of a plurality of metal filaments 4 and a pair of supporting members 6,7 of an insulating rubber each in the form of an elongated bar body having an approximately triangular cross section. The supporting members 6,7 are adhesively bonded together at the side surfaces 6A,7A in a staggered or displaced disposition with symmetry around the center line P sandwiching the array of the metal filaments 4 each running in a direction inclined relative to the up-to-down direction when the connector is placed on a circuit board 13 so as to be in contact at one end with the electrode terminal 12A on the first circuit board 12 and at the other end with the electrode terminal 13A on the second circuit board 13 when the connector 11 is interposed between the two circuit boards 12,13.

As is illustrated in FIG. 1, the bonding side surfaces 6A,7A of the supporting members 6,7 are not entirely bonded each to the other but are displaced each from the other so that the array of the metal filaments 4 is sandwiched between the supporting members 6,7 only in the middle part thereof and the metal filaments 4 are adhesively bonded only to the first supporting member 6 in the lower part of the surface 6A and only to the second supporting member 7 in the upper part of the surface 7A.

When the press-contact connector 11 is interposed between the circuit boards 12,13 with each of the metal filaments 4 in contact with the electrode terminals 12A and 13A at the upper and lower ends, respectively, a first elongated void space 14 having a triangular cross section is formed as defined by the first circuit board 12, the first supporting member 6 and the upper part of the array of the metal filaments 4 where the metal filaments 4 are adhesively bonded to the second supporting member 7 only on the surface 7A while a second elongated void space 15 also having a triangular cross section is formed as defined by the second circuit board 13, the second supporting member 7 and the lower part of the array of the metal filaments 4 where the metal filaments 4 are adhesively bonded to the first supporting member 6 only on the surface 6A.

The metal filaments 4 are aligned in parallel each to the others running in the direction perpendicular to the longitudinal direction of the bar member 6 or 7 at a regular interval space of at least 0.02 mm forming an array which is sandwiched, as is described above, by the first and second supporting rubber members 6,7 between the surfaces 6A,7A in such a fashion that each of the metal filaments 4 is in contact at the upper and lower ends with one of the electrode terminals 12A on the first circuit board 12 and with one of the electrode terminals 13A on the second circuit board 13 thus to establish electrical connection of the electrode terminals 12A and 13A when the connector 11 is interposed between the circuit boards 12,13.

When the first circuit board 12 is pressed down by applying a force F, as is shown by the arrows F,F in FIG. 2, toward the second circuit board 13, each of the first and second supporting rubber members 6,7 is elastically deformed in such a fashion that the distance between the circuit boards 12,13 is decreased along with a decrease in the angle α made between the circuit board 12 or 13 and the metal filaments 4 running with an inclination relative to the surfaces of the circuit boards 12,13. It is preferable that the angle α in the press-contacting condition is in the range from 30° to 60° or, more preferably, about 45° in respect of prevention of buckling in the supporting rubber members 6,7 and absorption of lateral displacement of the connector 11 by compression. When the press-contact connector 11 is interposed with compression between the circuit boards 12,13, improved reliability can be obtained in the electrical connection between the electrode terminals 12A,13A and the end points of the metal filament 4 by virtue of the increased contacting pressure therebetween given by the elastic resilience of the supporting rubber members 6,7 under compressive deformation.

The metal filaments 4 are made from a corrosion-resistant metal such as a stainless steel or made from phosphor bronze, beryllium bronze and the like and preferably plated on the surface with a corrosion-resistant metal such as gold to further improve corrosion resistance. Each of the metal filaments 4 has a cross sectional dimension in the range from 0.01 to 0.5 mm or, preferably, from 0.02 to 0.5 mm. When the diameter or thickness of the metal filaments 4, which may have a rectangular cross section, is too small, the conductive filaments 4 are so fragile that the serviceable life of the connector 11 is necessarily decreased. When the thickness of the conductive filaments 4 is too large, the compressive load F cannot be decreased in order to establish reliable electrical connection due to overly rigidity of the filaments 4.

Figure 3:
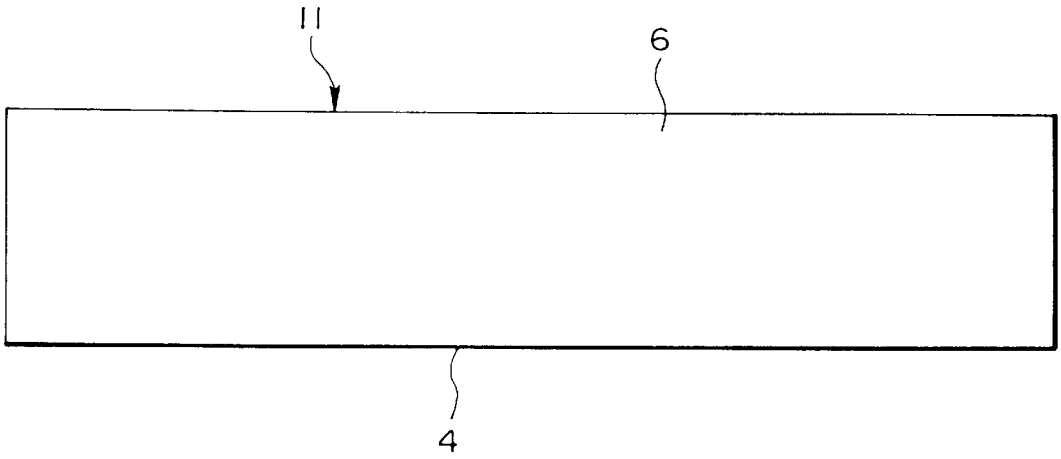
FIGS. 3 and 4 are a front view and cross sectional view, respectively, of the inventive press-contact connector.
Figure 4:
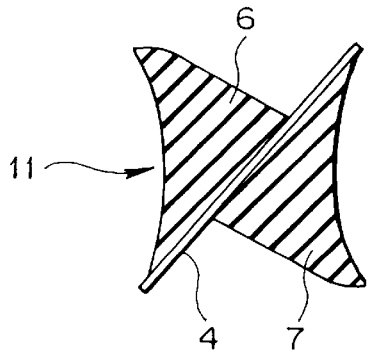

FIGS. 3 and 4 show a front view and a cross sectional view of the press-contact connector 11, respectively. Each of the supporting rubber members 6,7, which is made from an insulating rubber such as a silicone rubber having excellent weatherability, heat resistance, moisture resistance, anti-chemical resistance, aging retardation and electric insulation, is an elongated bar-formed member having an approximately triangular cross section. The rubbery material forming the supporting members 6,7 has a rubber hardness in the range from 10° H to 70° H or, preferably, from 30° H to 60° H according to the JIS scale. When the rubber hardness of the rubbery material, e.g., silicone rubbers, is too low, the rubber members 6,7 have stickiness of touch feeling on the surface even after full curing to cause a problem of slipping behavior in press-contacting of the connector 11 and in handling of the connector 11. When the rubber hardness is too high, on the other hand, it is a possible drawback, though dependent on the cross sectional configuration of the rubber members 6,7, that reliable electrical connection can be obtained between the electrode terminals 12A, 13A and the end points of the metal filaments 4 only by unduly increasing the contacting pressure F.

In the following, a typical method for the preparation of the above described press-contact connector is described in detail by making reference to FIGS. 5 to 9.

Figure 5:
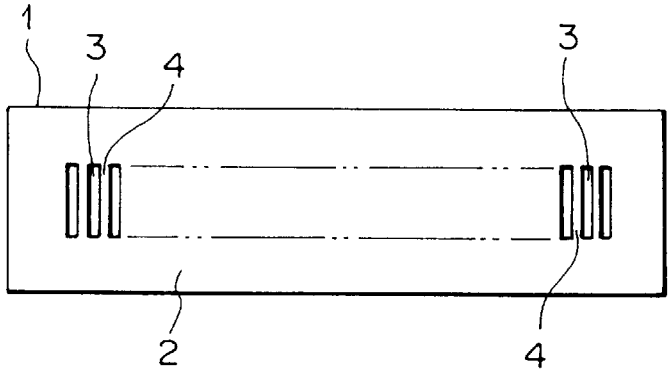
FIG. 5 is a plan view of a conductive sheet used in the preparation of the inventive press-contact connector.
Figure 6:
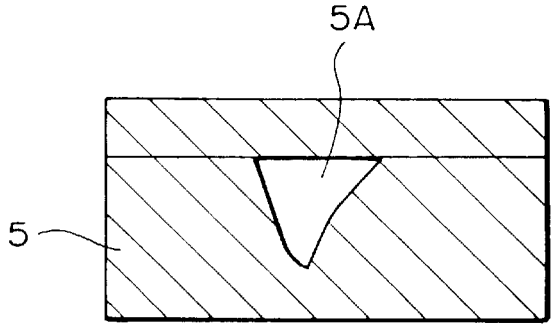
FIG. 6 is an illustration showing a cross section of the metal mold for molding preparation of the first and second supporting rubber members in the inventive press-contact connector.

In the first place, an electroconductive sheet 1 is worked by etching to form a plurality of slits 3 within the region surrounded by the rectangular frame-formed area 2 at a regular pitch so that a plurality of electroconductive metal filaments 4 are left unetched in a parallel alignment of grating between the slits 3 at a regular pitch capable of keeping insulation between filaments 4 (FIG. 5). This electroconductive sheet 1 is made from a corrosion-resistant metal such as stainless steel or should be provided with a corrosion-resistant plating of gold on the surface after the etching treatment.

Figure 7:
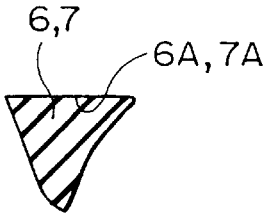
FIG. 7 is a cross sectional view of the first and second supporting members on the way of preparation of the inventive press-contact connector.
Figure 8:
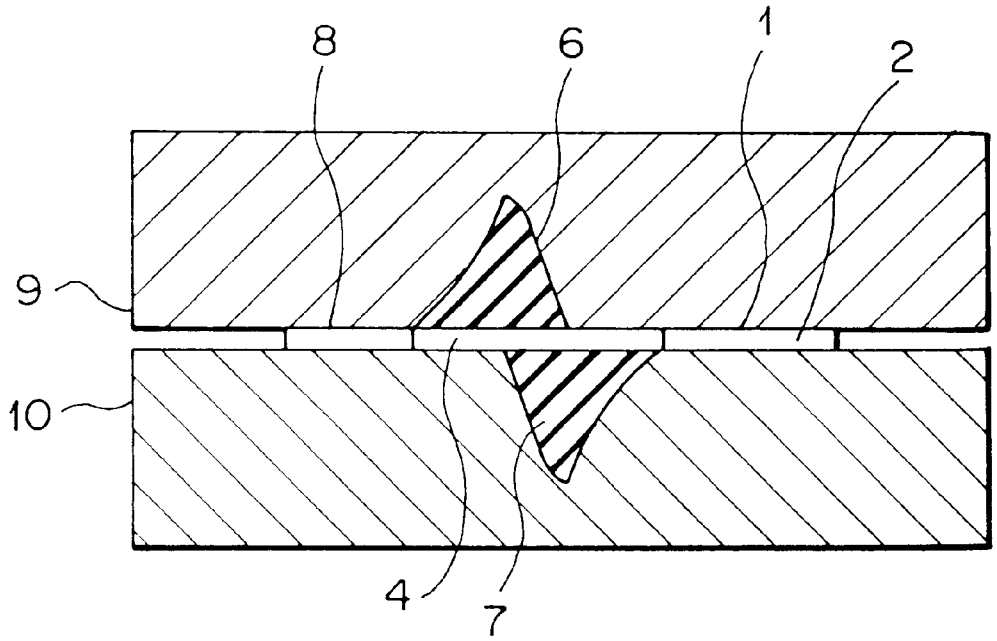
FIG. 8 is an illustration of the intermediate body held by jigs in the preparation of the inventive press-contact connector.
Figure 13:
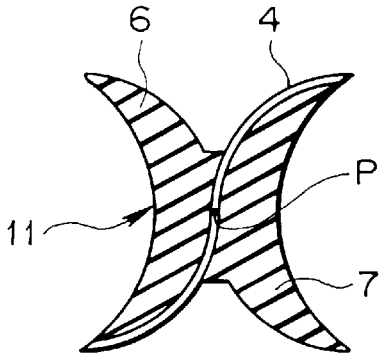
Figure 15:
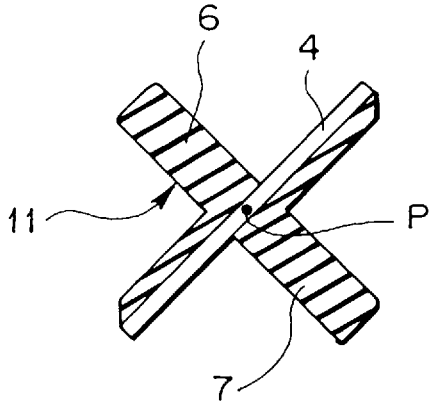

Separately, the molding cavity 5A of a metal mold 5 (FIG. 6) is filled with an uncured silicone rubber compound which is heated and cured under compression in the metal mold 5 into a prismatic bar member of the cured silicone rubber having an approximately triangular cross section to serve as the first and second supporting members 6,7 shown in FIG. 7 by a cross sectional view of the bar member. The cross section of the supporting members 6,7 can be crescent-formed as is illustrated in FIG. 13 or L-formed as is illustrated in FIG. 15 as a modification of the approximately triangular cross sectional profile of the supporting members 6,7 illustrated in FIG. 4.

Figure 9:
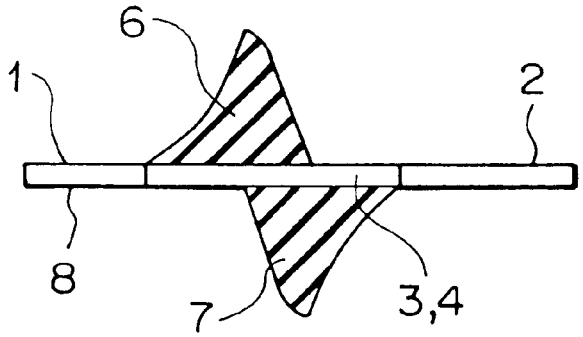
FIG. 9 is an illustration of the intermediate body taken out of the jigs.

In the next place, each of the first and second supporting members 6,7 is coated on the flat back surface 6A,7A with a silicone-based adhesive and the supporting members 6,7 are held in jigs 9,10 and adhesively bonded together at the adhesive-coated surfaces 6A,7A in a staggered or displaced disposition with the array of the conductive filaments 4 sandwiched therebetween on the center portion of the array 4 in a symmetrical fashion by using the jigs 9,10 (FIG. 8) to give an intermediate body 8 of the inventive press-contact connector 11 still carrying the frame-formed portion 2 of the conductive sheet 1 (FIG. 9).

Figure 10:
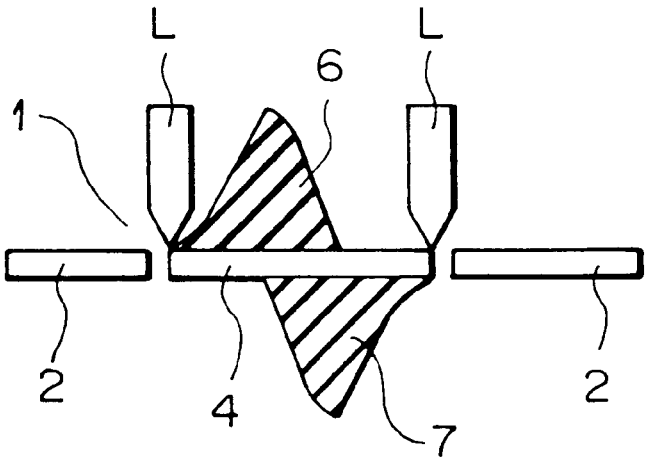
FIG. 10 is an illustration of trimming of the intermediate body shown in FIG. 9.
Figure 11:
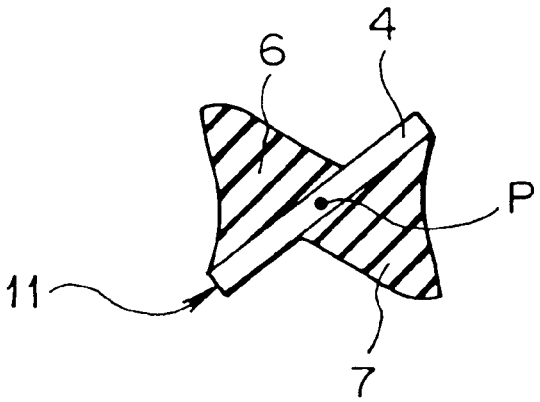
FIG. 11 is a cross sectional view of the inventive connector obtained by trimming according to FIG. 10.

The next and final step is trimming of the intermediate body 8 obtained as described above and removed from the jigs 9,10 by cutting the metal filaments 4 along the peripheries of the supporting members 6,7 with a suitable cutting machine such as a laser beam cutter L (FIG. 10) to give a finished press-contact connector 11 (FIG. 11) by removing the frame-formed marginal portion 2 of the conductive sheet 1. If necessary, the thus obtained connector 11 in the form of an elongated bar body can be further divided into a plurality of pieces having a smaller unit length by cutting along the longitudinal direction of the bar member 11 perpendicularly to the longitudinal direction.

The press-contact connector 11 prepared in the above described manner is used in such a manner illustrated in FIGS. 1 and 2 by being interposed between two oppositely facing circuit boards 12,13 to make electrical connection between corresponding electrode terminals 12A,13A on the respective circuit boards 12,13 by contacting of the electrode terminals 12A,13A with the end points of the conductive metal filaments 4 under an appropriate contacting pressure.

When the press-contact connector 11 having the above described elongated structure is interposed between a first circuit board 12 and a second circuit board 13 as is illustrated in FIG. 1, elongated void spaces 14,15 each having an approximately triangular cross section are formed as defined, one, by the first circuit board 12, a side surface of the first supporting member 6 and the array of the conductive metal filaments 4 and, the other, by the second circuit board 13, a side surface of the second supporting member 7 and the array of the conductive metal filaments 4.

As the first circuit board 12 is pressed down against the second circuit board 13 by applying a force F, as is illustrated in FIG. 2, the supporting members 6,7 are each elastically deformed and the void spaces 14,15 having an approximately triangular cross section are also flattened so that the conductive filaments 4 are brought at the end points sliding along the surface of the electrode terminals 12A,13A keeping contact with the electrode terminals 12A,13A on the respective circuit boards 12,13 with increased reliability to establish electrical connection under the elastic resilience exhibited by the supporting members 6,7 under elastic deformation. With such a unique construction of the press-contact connector 11 of the invention, the rubber hardness of the supporting members 6,7 need not be particularly low as is the case in conventional press-contact connectors utilizing elastic resilience of rubber-made parts so that the rubber material forming the supporting members 6,7 has an advantageously low permanent compression set and less susceptibility to the loss of rubbery elasticity at an elevated temperature as well as easiness in handling.

In addition, the reliability of electrical connection obtained with the inventive press-contact connector 11 is not affected by the amount of pressing down of the first circuit board 12 against the second circuit board 13 to give an advantage that any mounting errors of the connector 11 can readily be absorbed to decrease troubles due to failure of electrical connection. Moreover, no auxiliary parts are required in mounting the inventive press-contact connector 11 so that the connecting height can be decreased. Each of the conductive filaments 4, being supported over the whole length by the supporting members 6,7, is free from any constrained deformation so as to be freed from the trouble of buckling and to contribute to the improvement of reliability of electric connection even under repeating of the compressive force F.

The rubbery material forming the supporting members 6,7 is preferably a silicone rubber having a rubber hardness of 10° H to 70° H as defined in JIS. Silicone rubbers are advantageous as compared with conventional organic rubbers in respects of high chemical stability by virtue of the absence of any unsaturated linkages in the molecular structure, little temperature dependency of mechanical properties, low permanent compression set, high heat resistance and good electric insulation.

Figure 12:
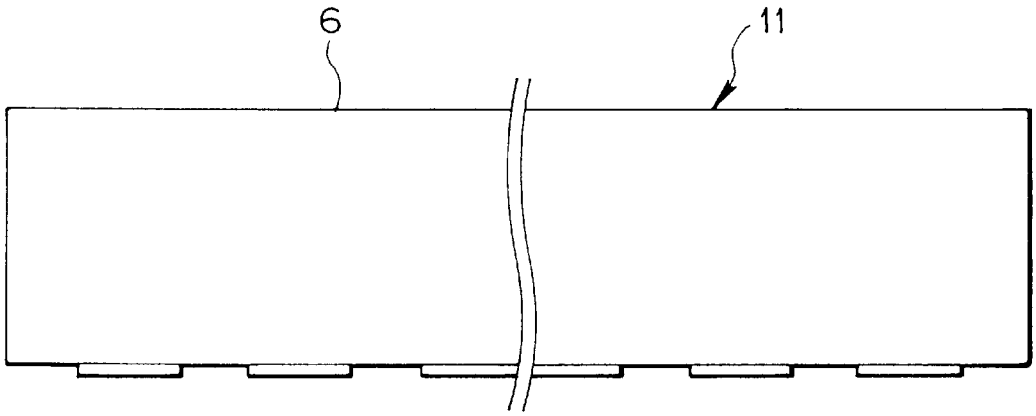
FIGS. 12 and 13 are a front view and a cross sectional view, respectively, of the inventive press-contact connector having a crescent-formed cross section of the supporting members.
Figure 14:
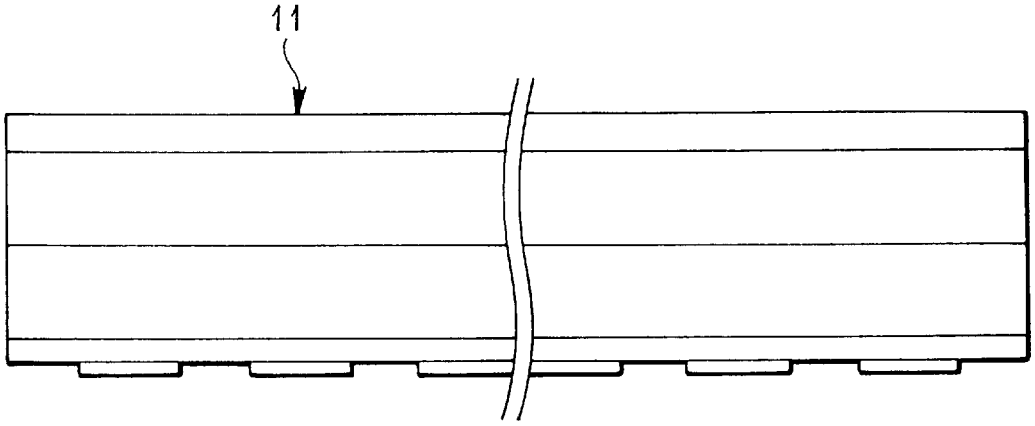
FIGS. 14 and 15 are a front view and a cross sectional view, respectively, of the inventive press-contact connector having an L-formed cross section of the supporting members.

While the above description of the inventive press-contact connector is given solely for the supporting members 6,7 each in the form of an elongated bar body having an approximately triangular cross section, various modifications are possible relative to the cross sectional configuration of the supporting members 6,7. For example, as is illustrated in FIGS. 12 and 13, each of the supporting members 6,7 of an insulating rubber may have a crescent-formed cross section and the conductive filaments 4 may be curved in an S-form (FIG. 13). FIGS. 14 and 15 illustrate another modification of the cross sectional profile of the supporting members 6,7, each of which has an L-shaped cross section jointly to exhibit an X-formed cross section of the supporting members 6,7 when they are adhesively bonded together (FIG. 15).

In each of these variations, it is preferable that the running direction of the conductive filaments 4 makes an angle with the surface of the circuit boards 12,13 in the range from 30° to 60° or, more preferably, about 45° in a pressed-down condition as shown in FIG. 2. This angle limitation of the conductive filaments 4 is applicable also to the variation illustrated in FIG. 13 in which the conductive filament 4 4 takes an S-curved configuration by reading the direction of the filament per se so as to mean the direction of the line connecting the upper and lower end points of the filament 4.

In the following, the press-contact connector of the present invention is described in more detail by way of examples.

EXAMPLE 1.

A procedure for the preparation of the press-contact connector 11 is described by making reference to FIGS. 5 to 11. In the first place, a 30 mm by 100 mm wide stainless steel sheet 1 of 20 μm thickness was subjected to an etching treatment to form a plurality of slits 3 at a regular pitch of 0.07 mm within the 10 mm by 80 mm wide area surrounded by a framed area 2 of 10 mm width so as to leave a plurality of conductive filaments 4 each having a length of 10 mm arranged in a parallel alignment each between the slits 3 to form an array of the filaments 4 forming a grating. Separately, the molding cavity 5A of a metal mold 5 was filled with a silicone rubber compound (KE 151U, a product by Shin-Etsu Chemical Co.) compounded with a curing agent and the metal mold 5 was closed to cure the silicone rubber compound at 120° C. for 5 minutes under compression to give first and second supporting members 6,7 of a cured silicone rubber of 50° H rubber hardness each in the form of an elongated bar-shaped body having an approximately triangular cross section with a flat surfaces 6A,7A (FIG. 7).

In the next place, the respective flat surfaces 6A,7A of the above obtained supporting members 6,7 each having an approximately triangular cross section were coated with a silicone-based adhesive (KE 1800TA/TB, a product by Shin-Etsu Chemical Co.) in a thickness of 20 μm and they were bonded together in a displaced disposition with intervention of the array of the conductive filaments 4 by utilizing the jigs 9,10 (FIG. 8) for adhesive bonding with interposition of the array of the conductive filaments 4 formed in the electroconductive sheet 1 to give an intermediate body 8 (FIGS. 8 and 9) of the inventive press-contact connector.

The intermediate body 8 removed from the jigs 9,10 for the adhesive bonding work was subjected to trimming to remove portions of the conductive filaments 4 protruded out of the peripheries of the supporting members 6,7 and the frame portion 2 of the conductive sheet 1 by cutting with an excimer laser beam cutter machine L (FIG. 10) to give a press-contact connector 11 in the form of an elongated bar body illustrated in FIGS. 3 and 4 which was divided by cutting into connectors of a unit length.

EXAMPLE 2.

A press-contact connector 11 of the invention, of which each of the supporting members 6,7 had a crescent-formed cross section illustrated in FIGS. 12 and 13, was prepared in substantially the same manner as in Example 1 except that the electroconductive sheet 1 of phosphor bronse, instead of stainless steel, had a thickness of 50 μm, the slits 3 were formed at a regular pitch of 1.0 mm and the supporting members 6,7 having a crescent-formed cross section were formed from a silicone rubber compound KE 151U (a product by Shin-Etsu Chemical Co.) to give a cured silicone rubber having a rubber hardness of 50° H in the JIS scale.

EXAMPLE 3.

A press-contact connector 11, of which each of the supporting members 6,7 had an L-shaped cross section as illustrated in FIGS. 14 and 15, was prepared in substantially the same manner as in Example 2 excepting for the use of a silicone rubber compound KE 961U (a product by Shin-Etsu Chemical Co.) to give the supporting members 6,7 of a cured silicone rubber having a rubber hardness of 60°H in place of KE 151U and the use of an electroconductive sheet 1 of beryllium bronze instead of phosphor bronze.

What is claimed is:

1. A press-contact connector for electrical connection between electrode terminals on oppositely facing first and second circuit boards by being interposed therebetween under a contacting pressure applied between the circuit boards, which is an elongated integral bar-formed body comprising:

(a) a pair of a first supporting member and a second supporting member each made from an electrically insulating rubber in the form of an elongated bar body having an approximately triangular cross section and adhesively bonded together at one side surface of each of the first and second supporting members in a displaced disposition, the first supporting member coming into contact with the first circuit board and the second supporting member coming into contact with the second circuit board when the connector is interposed between the first and second circuit boards, with the interface plane inclined relative to the surfaces at which the supporting members are in contact with the circuit boards; and (b) an array of a plurality of electroconductive filaments in a parallel alignment sandwiched between the first and second supporting members at the adhesively bonded interface, each of the filaments extending to reach electrode terminals on the first and second circuit boards by running in an inclined direction perpendicularly to the longitudinal direction of the first and second supporting members, in which the first and second supporting members are disposed symmetrically relative to the center line on the interface between the first and second supporting members, a first elongated void space is formed as defined by the first supporting member, the array of the filaments and the first circuit board and a second elongated void space is formed as defined by the second supporting member, the array of the filaments and the second circuit board.

2. The press-contact connector as claimed in claim 1 in which the electroconductive filaments each have a diameter or thickness in the direction perpendicular to the plane of the array thereof in the range from 0.01 to 0.5 mm.

3. The press-contact connector as claimed in claim 1 in which the electroconductive filaments are made from a metal or an alloy.

4. The press-contact connector as claimed in claim 3 in which the electroconductive filaments made from a metal or alloy have a corrosion-resistant plating layer.

5. The press-contact connector as claimed in claim 1 in which the rubber forming the first and second supporting members has a rubber hardness in the range from 30° H to 60° H according to the JIS scale.

6. The press-contact connector as claimed in claim 1 in which the rubber forming the first and second supporting members is a silicone rubber.

7. A method for the preparation of a press-contact connector for electrical connection between two circuit boards as defined in claim 1 which comprises the steps of:

(A) compression-molding a rubber compound to give elongated bar bodies each having an approximately triangular cross section to serve as the first and second supporting members;

(B) forming an array of a plurality of metal filaments in a parallel alignment at a regular pitch within a rectangular area of and supported by a frame-formed marginal area of a metal sheet by an etching treatment of the metal sheet;

(C) coating one of the side surfaces of each of the supporting members prepared in step (A) with an adhesive;

(D) bonding the supporting members at the adhesive-coated surfaces thereof in a displaced disposition with the array of a plurality of metal filaments prepared in step (B) sandwiched between the supporting members at the adhesively bonded interface, the metal filaments still being supported by the frame-formed area of the metal sheet; and (E) removing the frame-formed metal sheet by cutting the metal filaments along the peripheries of the supporting members.

8. A method for electrical connection of sets of electrode terminals on oppositely facing first and second circuit boards by using the press-contact connector defined in claim 1 which comprises the steps of:

(1) interposing the press-contact connector between the circuit boards in such a fashion that the end points of the electroconductive filaments are in contact with the electrode terminals of the first and second circuit boards; and (2) applying a compressive force between the first and second circuit boards to exhibit such an amount of compression that the array of the electroconductive filaments makes an angle in the range from 30° to 60° with the surfaces of the circuit boards.

* * * * *